United States Patent [19]

Bielski et al.

[11] 4,083,752

[45] Apr. 11, 1978

[54] ROTARY RETORT

[75] Inventors: Edward T. Bielski, Crofton, Md.; Timothy J. Fowler, St. Louis, Mo.

[73] Assignee: Monsanto Company, St. Louis, Mo.

[21] Appl. No.: 740,635

[22] Filed: Nov. 10, 1976

[51] Int. Cl.[2] ..... C10B 1/10; C10B 45/00; F27B 7/00

[52] U.S. Cl. ..... 202/100; 202/131; 202/216; 202/218; 202/268; 432/103; 432/251; 110/246; 110/336

[58] Field of Search ..... 432/251, 103; 165/89; 202/100, 131, 216, 218, 268; 110/1 A, 14; 34/108

[56] References Cited

U.S. PATENT DOCUMENTS

| | | | |
|---|---|---|---|
| 2,082,870 | 6/1939 | Caffrey | 110/14 |
| 2,089,026 | 8/1937 | Hoffman | 432/251 X |
| 2,420,135 | 5/1947 | Hennig | 432/251 X |
| 3,888,621 | 6/1975 | Williams | 432/103 X |

FOREIGN PATENT DOCUMENTS

| | | | |
|---|---|---|---|
| 431,987 | 7/1926 | Germany | 432/103 |

*Primary Examiner*—Morris O. Wolk
*Assistant Examiner*—Arnold Turk
*Attorney, Agent, or Firm*—Arthur E. Hoffman

[57] ABSTRACT

The ends of refractory-lined rotary kilns are often subjected to such intense heat flux that the steel shell of the kiln at either or both ends is subjected to substantial thermal expansion in both the longitudinal and circumferential directions, resulting in premature cracking and failure of the refractory. The present apparatus is a rotary kiln wherein either or both ends of the steel shell thereof are provided with a plurality of substantially longitudinal slots which accommodate circumferential expansion and the refractory is affixed to the steel shell at such end(s) with sliding anchors to accommodate longitudinal expansion.

15 Claims, 7 Drawing Figures

ROTARY RETORT

BACKGROUND OF THE INVENTION

This invention relates to an improved rotary kiln. More particularly it relates to an improved refractory lined rotary kiln wherein either or both ends of the cylindrical steel outer shell of the kiln are exposed to a substantially greater heat flux than the steel shell remote from such end or ends is exposed to.

The refractory lining provides most of the steel shell with good insulation against the intense heat within the kiln. Moreover, over most of the kiln length, the steel shell is exposed to the atmosphere which cools the steel shell. It is extremely difficult, however, to adequately shield the ends of the steel shell against such heat, and since the ends of rotary kilns are normally enclosed by hoods, the ends of the steel shell do not receive the benefit of atmospheric cooling. The resulting temperature differential between the end of the steel shell and the portion of the steel shell remote from this end results in more severe thermal expansion of the end of the steel shell in both the longitudinal and circumferential (with respect to the longitudinal axis of the rotary kiln) directions, placing severe mechanical stresses upon the refractory lining which usually is fixedly attached to the steel shell, often resulting in premature cracking and failure of the refractory.

While this can be a problem no matter what the operating temperature profile within the kiln may be, it becomes especially severe when the temperature profile within the kiln is such that either or both ends thereof are operated at temperatures significantly higher than in adjacent zones within the kiln.

For example, the problem can be particularly severe with direct-fired rotary kilns where one or more burner nozzles project into a burner hood at one end of the kiln. As a result of the intense heat from such burner, the cylindrical steel kiln shell at the burner end, even though lined with refractory is normally heated to a substantially higher temperature than the portions of the steel shell which are more remote from the burner end. Thus, this end of the kiln is often subjected to extremely great thermal expansion which causes greater expansion of the end of the steel shell in both the longitudinal and circumferential (with respect to the longitudinal axis of the kiln) directions and places severe mechanical stresses upon the refractrory lining which normally is fixedly attached to the steel shell, often resulting in premature cracking and failure of the refractory.

This problem becomes particularly acute in direct-fired rotary kilns for pyrolysis of carbonaceous materials wherein air, oxygen or another oxygen-containing gas is admitted to the kiln at the burner end for the in situ combusion of part or all of the pyrolysis gases. In such kilns the burner may be used only for start-up with the in situ combustion of the pyrolysis gas providing all of the thermal energy necessary to effect pyrolysis, or the burner may be in continuous or intermittent operation as a source of supplemental thermal energy after steady-state pyrolysis is attained, depending upon process requirements. In any event, extremely high temperatures, e.g., above 1900°-2200° F are frequently present in the burner end of the kiln because of the combusting pyrolysis gases.

Similar problems are often encountered at the other end of the rotary kiln as well. For example, extremely hot off-gases from the kiln can subject this end of the rotary kiln to a great heat flux as well.

DESCRIPTION OF THE PRIOR ART

The present invention is applicable to either direct-fired or indirectly heated rotary kilns, both types of kiln being well-known in the art.

The prior art has taught several approaches to solution of this problem, generally directed at reducing the heat flux into the affected end of the steel shell of the kiln.

Air or water cooling of the end of the steel shell has been used whereby an air or water jacket is provided for the end of the steel shell to remove the heat flux thereto by heat transfer. This is expensive in terms of both initial cost and continual operating expense. Water cooling also presents maintenance problems because of the high temperature differential across the steel shell where its outer surface is in contact with the water.

Radiation shields have been used to shield the tip of the steel shell from the intense heat and thus reduce the heat flux entering the end of the steel shell. These are often only marginally effective since it is difficult to provide a radiation shield which has insulative qualities even approaching the insulative protection the refractory lining provides to the steel shell further into the kiln. Thus a severe temperature differential normally still exists between the end of the steel shell and the portion of the steel shell more remote from the very end thereof.

SUMMARY OF THE INVENTION

If is an object of this invention to provide an improved rotary kiln wherein mechanical stresses upon the refractory lining, caused by thermal expansion of the steel kiln kiln shell at the ends thereof, are greatly reduced.

Another object is the provision of an improved rotary kiln wherein rather than reduce the heat flux in an end of the steel shell to alleviate the thermal expansion problem, the design of the kiln is such as to accommodate the thermal expansion of that end of the steel shell without undue stress upon the refractory lining.

Another object is the provision of an improved direct-fired rotary kiln wherein at least the burner end of the kiln is fabricated such that the thermal expansion of the steel shell of the kiln at said end thereof is accommodated without undue deflection of the steel shell away from the refractory lining and without placing the refractory lining under such mechanical stress as to cause premature cracking and failure of the refractory, even when exposed to severe operating temperatures at said burner end.

These and other objects are attained by a rotary kiln comprising a cylindrical steel shell lined with a refractory material wherein either or both ends of the steel shell are provided with a plurality of generally parallel slots spaced substantially equi-distant around the circumference of said end of the kiln, said slots extending longitudinally from said end of the kiln to a point on said steel shell remote from said end where the thermal expansion of the steel shell no longer places an unacceptable stress upon the refractory lining, said slots being of sufficient width and frequency to accommodate the circumferential expansion of said steel shell at operating temperatures, and each segment of said steel shell between slots being affixed to the refractory lining by at least one sliding anchor means to accommodate the longitudinal expansion of said steel shell.

The width of the slots, their length, and the space between slots around the circumference of the steel shell at the end of the kiln under consideration are functions of (1) the temperature profile within the kiln during operation, and particularly the temperature reached in that end of the kiln, (2) the kiln diameter at that end, (3) the coeffecient of expansion of the steel used to fabricate that end of the steel shell, and (4) the spacing of the anchors by which the refractory lining is held against the steel shell.

Thus, the width of each slot and the spacing between slots should be such that the circumferential expansion of the steel shell segment between each pair of slots can essentially be absorbed by circumferential expansion of each slotted segment into the open slot. In this way, radial deflection of the steel shell in the end of the kiln away from the refractory lining is substantially reduced. Substantially equi-distant spacing of the slots is preferred so as to minimize or avoid cylindrical distortion of the steel shell.

The mechanical load of the refractory lining places practical requirements on the positioning and spacing of the anchors used to support the refractory lining in accordance with good engineering practice. The location of the anchors and of the slots are preferably planned such that circumferential expansion of a slotted segment does not place unacceptable circumferentially oriented stresses upon the refractory. THus, advantageously if the anchors are installed in rows (when viewed along the longitudinal axis of the kiln), the slots will be located between each row of anchors. If the anchors are staggered (again viewed along the longitudinal axis of the kiln), then stress vectors in the refractory because of inability of the anchors to accommodate circumferential expansion of the slotted segment of the kiln shell should be calculated in order to locate the slots so as to avoid potentially damaging stresses on the refractory.

Although the slots should be generally parallel and substantially equi-distant so that all slotted segments will be substantially the same, the slots need not be oriented parallel to the longitudinal axis of the kiln, but may if desired be oriented at any angle up to about 45° from the longitudinal axis, but preferably not more than 10° to 15° from the longitudinal axis which may advantageously be employed to reduce axial cracking of the refractory. In some instances, for example, when the anchors are to be staggered, slots running at an angle may advantageously be used to reduce or eliminate stresses in the refractory between anchors in directions the sliding anchors cannot accommodate. When slots running at some angle from the longitudinal kiln axis are used, the sliding anchors should be installed so as to allow them to slide along a line from the point of fixity of the refractory to the shell since relative longitudinal thermal expansion between the steel shell and refractory within the slotted segments will not necessarily be in a direction parallel to the longitudinal axis of the kiln, but rather will be in a direction away from the governing fixed anchor.

The length of the slots should be such that they extend to a point along the steel shell sufficiently remote from the tip thereof where the steel shell is no longer subjected to such high temperature or heat flux as to cause an unacceptable degree of thermal expansion from the standpoint of placing an undue stress upon the refractory lining at that point.

Slots of, for example, from 3/16 to ¾ inches width may be suitably used at intervals of from 8 to 15 inches about the circumference of rotary kilns of 12 feet in diameter and larger. In kilns of lesser diameter, somewhat closer spacing of the slots may be desirable.

Slots of, for example, from 15 to 30 inches in length may be suitably used depending upon the thermal conductivity of the steel used in the shell, how well the steel shell is insulated by the refractory lining, the temperature profile in the steel shell, and how much cooling of the steel shell is obtained by exposure to the atmosphere or by an air or water cooling means. In rotary kilns equipped with seals between a stationary hood and the rotating kiln to prevent leakage of air into the kiln (e.g., pyrolysis kilns) or leakage of gases from the kiln, the slots preferably should not extend beyond the seals, depending upon the slot width, depth and the amount of leakage which can be tolerated.

The strength of the slotted segments required for support of the refractory lining is another factor which must be considered insofar as the spacing between slots and their length is concerned.

One skilled in the art will readily be able to calculate the slot requirements for any given kiln installation on the basis of the teaching contained herein.

The slots are preferably fabricated such that they are rounded at the end when viewed perpendicularly to the steel shell of the kiln, as shown in FIG. 6. More preferably the ends of the slots are wider than the width thereof through the remainder of their length; which can be accomplished through various wellknown means, for example, by drilling the ends of the slots. The thus wider and rounded slot endings reduce the concentration of mechanical stresses at the junction between the slotted segments and the rest of the steel shell.

In many instances, it is advantageous, or process operating conditions or the material being processed may require, fabrication of the nose end of the steel kiln shell from a different steel than is used in the remainder of the steel shell. For example, carbon steel is commonly used for the shell of a rotary kiln. Extremely high temperatures and/or corrosive gases may, however, require fabrication of either of both ends of the steel shell of a more resistant steel, such as, for example, stainless steel. These more resistant steels frequently have a higher thermal coefficient of expansion than does, for example, carbon steel. Thus, the problem of thermal expansion of the end of the kiln often becomes much more serious when the resistant steel is used to fabricate the end of the steel shell, welding it to a lower thermal coefficient of expansion, e.g., carbon steel.

Normally, the end made of the special resistant steel need not comprise any greater proportion of the steel shell than is needed to satisfy the purpose for which it is needed. In a rotary kiln of 12 foot or more diameter, for example, extremely high burner end temperatures of, e.g., 1900° to 2500° F make the use of a stainless steel nose end advantageous for only the first 12 to 24 inches of the kiln length and the remainder of the kiln shell may be fabricated of more conventional steel such as carbon steel. It should be noted that the other end of the kiln, normally the feed end of the kiln, may also have its own requirements as to the steel used in the shell there.

In an embodiment such as in the preceding paragraph, the resistant steel used at the end of the steel shell may end at a point along the kiln length where the deflection of the steel shell from thermal expansion is still unacceptably high. Thus, in such embodiment, it is preferred that the slots extend beyond the special steel section of the kiln shell. This is of particular advantage in any event since the difference in coefficient of expansion between the two different steels used in the kiln shell will result in a differential in the magnitude of thermal expansion of each steel. By continuing the slots through the weld and into the second steel section of the steel shell will avoid this problem since with appropriate spacing the slots will terminate the circumferential expansion of each steel shell segment between the slots.

It will be obvious to those skilled in the art that the greater the number of slots that are provided and the closer they are spaced, the less will be the circumferential expansion of each slotted segment of the steel shell at any given temperature. As mentioned above, the steel shell must, however, support the load of the refractory lining. Kiln design requires that this loading as well as mechanical strength and integrity of the kiln, metal fatigue and other convention engineering design factors well known to those skilled in the art, all be taken into consideration. The net result is that as a practical matter, it is not normally possible or even desirable to provide sufficient slots so as to eliminate circumferential expansion of the end of the steel kiln shell under high operating temperatures, since it is advantageous to allow some circumferential expansion thereof to accommodate the slight circumferential expansion of the refractory lining.

Since there is only slight expansion of the refractory lining even under the most severe temperatures, it is preferred that the refractory lining be affixed by at least one sliding anchor means to each slotted segment of the steel shell, particularly at locations where the longitudinal expansion of the steel shell is great enough to cause severe and potentially destructive mechanical stresses in the refractory and/or anchor if a conventional fixed anchor were used. The remainder of the kiln can have fixed anchors to secure the refractory to the steel shell.

Sliding anchoring systems are well know, though it is not believed that they have been used before in direct-fired rotary kilns. Any conventional sliding anchor system can be used recognizing that its function is to accommodate the longitudinal expansion of the steel shell. One type of sliding anchor employs a "T" or "L" shaped hanger secured to the steel shell with a slotted metal or ceramic (e.g., brick or refractory) block into which the cross-bar or arm of the hanger inserts, allowing movement of the hanger in at least one direction with respect to the block. In a preferred embodiment, the slotted block used will be of a ceramic material having substantially the same thickness as the refractory lining. FIGS. 6 and 7 portray a typical construction, showing the position of "T" type hangers in slots provided for them in a refractory brick.

If desired, and particularly advantageous under severe temperature conditions, auxiliary air or water cooling of the steel kiln shell can also be used at slotted end of the kiln to further reduce the thermal expansion.

As previously mentioned, this invention can be used for either or both ends of the rotary kiln as the particular situation may require. When used at both ends, it is not necessary that both ends be designed alike. The problem at one end of the kiln is not necessarily the same or of equal magnitude as that at the other end. Each end of the kiln can be independently designed according to the principles of this invention to satisfy the requirements for that end of the kiln.

The present invention finds particular application, however, in large diameter, e.g., from 12 to 25 feet or more in diameter, direct-fired rotary kilns used for the pyrolysis of carbonaceous materials such as, for example, petroleum coke, coal, municipal waste, etc., and more particularly in such pyrolysis kilns wherein at least a portion of the pyrolysis gases are combusted in situ with controlled quantities of air, oxygen or another oxygen-containing gas admitted to the kiln at the burner end thereof. The combusting burner fuel (when operating) and pyrolysis gases result in burner end temperatures often in excess of 1900° to 2200° F. Such high temperatures upon the large kiln diameter can cause severe thermal expansion of the steel shell at this end of the kiln.

Such pyrolysis kilns, and those particularly suited to the practice of this invention normally comprise a feed hood and carbonaceous material feed system at the other end of the kiln from the burner, with appropriate means used to prevent undesired air from entering the kiln with the feed, appropriate seals to prevent undesired air from leaking in at each end of the kiln, and an off-gas outlet at or near the feed end so as to provide counter-current flow between the gases and the bed of pyrolyzing material. Such a direct-fired rotary kiln is described in U.S. Pat. No. 3,794,565 which is hereby incorporated into and made a part of this specification by reference.

Frequently, the hot off-gases from such pyrolysis kilns also cause a severe thermal expansion problem in the feed end of the kiln, as well as at the burner end. In such instances, both ends of the kiln may be advantageously designed in accordance with this invention.

It can be seen that this invention offers a simple and inexpensive solution to the problem of severe thermal expansion at an end of the steel shell of the kiln. There is little or no additional capital cost and no operating cost, as contrasted with the captial and operating costs associated with cooling the end of the steel shell or shielding it against the heat. Moreover, this invention is an effective and inexpensive way to retrofit existing kilns experiencing frequent, costly shut-downs because of refractory failure.

This invention can be used with any refractory material. It is, however, preferred to use a reinforced castable refractory. Suitable reinforcing materials include, for example, graphite, asbestos, boron, metal or mineral oxide fibers.

DESCRIPTION OF THE PREFERRED EMBODIMENTS

Figure 1:
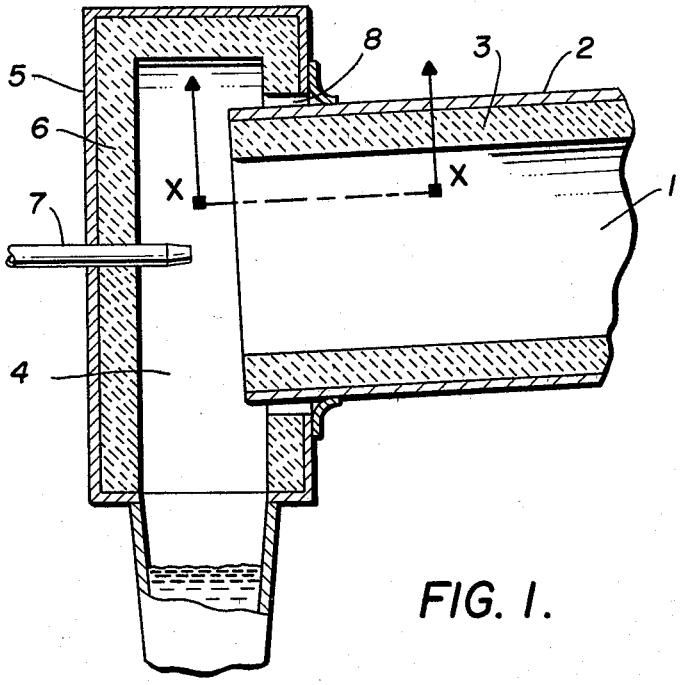
FIG. 1 is a side cross-sectional view of the burner end of a typical direct-fired rotary kiln of the type to which the present invention may be applied.

FIG. 1 shows the burner end of a typical direct-fired rotary kiln 1 comprising a steel outer shell 2 and a refractory lining 3. The end of kiln 1 projects into a burner hood 4 which similarly comprises a steel shell 5 and refractory lining 6. One or more burners 7 are disposed within the burner hood to burn fuel such as gas or oil. In a pyrolysis process, the burner may only be necessary during start-up if in situ combustion of some or all of the pyrolysis gases is used to provide the thermal energy required for pyrolysis, or as a source of supplementary heat, either continuously or intermittently, if only a portion of the necessary thermal energy is obtained from in situ combustion of the pyrolysis gases.

Since a rotary kiln is supported along its length by suitable trunions and bearings (not shown), the end of the kiln merely projects into a hood at either end with an annular space 8 defined therebetween. This annular space is normally sufficiently large that no binding occurs even with radial expansion of the steel shell from the intense heat at the end of the kiln.

Figure 2:
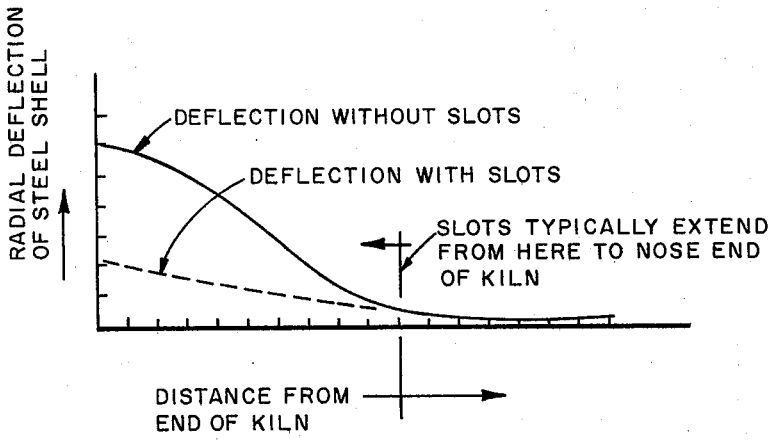
FIG. 2 is a graphic portrayal (to no particular scale) of the radial deflection of an end of the steel shell of a kiln under severe operating temperature, both with and without the slots of this invention, illustrating the decreased radial deflection of the end of the steel shell obtained by practice of this invention.
Figure 3:
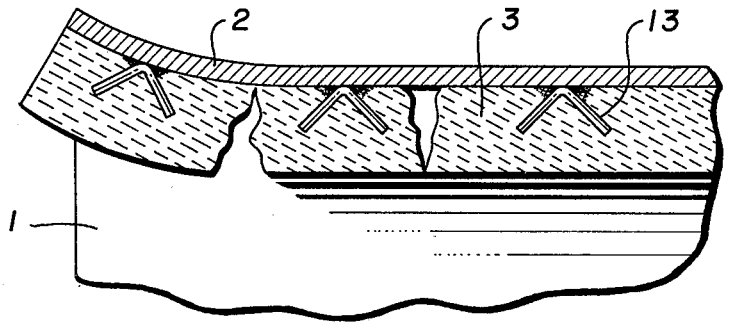
FIG. 3. PRIOR ART
FIG. 3 represents a sectional piece of an end of the kiln taken along lines X—X of FIG. 1 portraying the radial deflection of the steel shell and failure of the refractory lining under the influence of high temperature, illustrating the problem which this invention solves.

When subjected to intense heat, the end of the steel shell is often severely deflected from radial expansion as shown in the solid curve in the graph of FIG. 2 and as shown in FIG. 3. This radial deflection is most severe at the extreme end of the steel shell which normally is only partially or poorly insulated from the intense heat. The zone of severe radial deflection normally extends from this end to a point along the kiln remote from the end of the steel shell where radiational heat loss from the steel shell to the atmosphere as well as cooling by atmospheric air allows the steel shell temperature to normalize. The contour of the solid line in FIG. 2 indicates that this radial deflection is not linear at the end of the steel shell.

Figure 4:
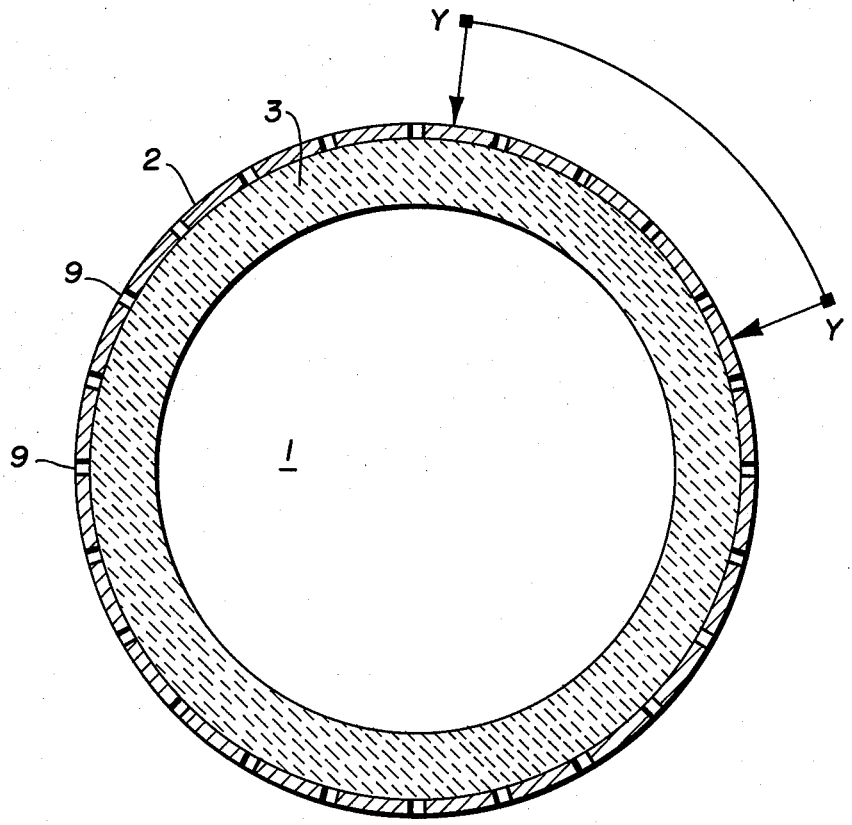
FIG. 4 is an end view taken along the longitudinal axis of the kiln, portraying a slotted end of the kiln.
Figure 5:
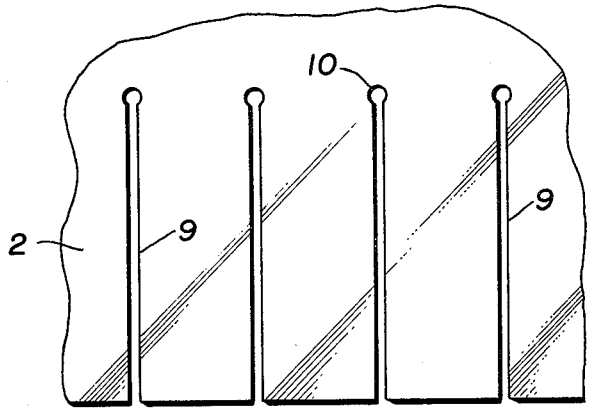
FIG. 5 is a developed plan view of a section of the slotted end of the kiln taken along lines Y—Y of FIG. 4.

Referring now to FIGS. 4 and 5, a plurality of slots 9 are provided in steel shell 2 at the end of the kiln. The slots may be made, for example, by saw cut or by burning out the steel to the desired width and length of the slot. In a preferred embodiment, the ends 10 of the slots are slightly wider and rounded. This can be accomplished, for example, by drilling the ends of the slots.

After slotting, the radial deflection of the end of the steel shell at equivalent operating temperatures will be reduced as shown in the dashed curve in FIG. 2. Note that not only has the radial deflection been reduced but that this deflection is also now substantially more linear along the longitudinal length of the slotted segment.

Figure 6:
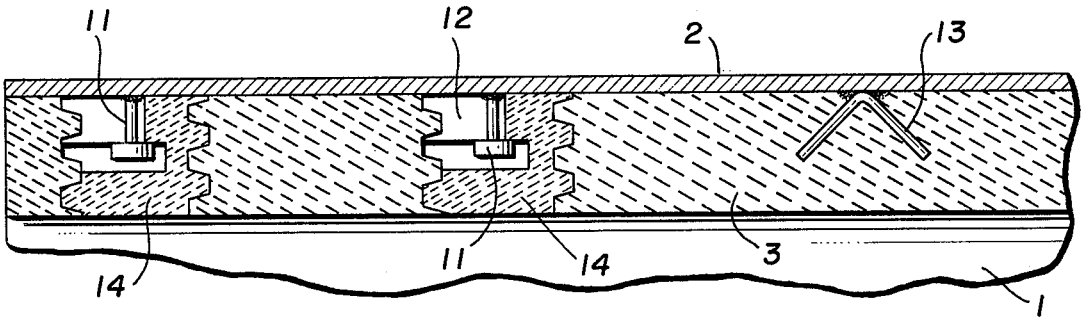
FIG. 6 is a side cross-sectional view of the end of the kiln taken along lines X—X of FIG. 1 showing one embodiment of a floating anchor system for supporting the refractory lining.
Figure 7:
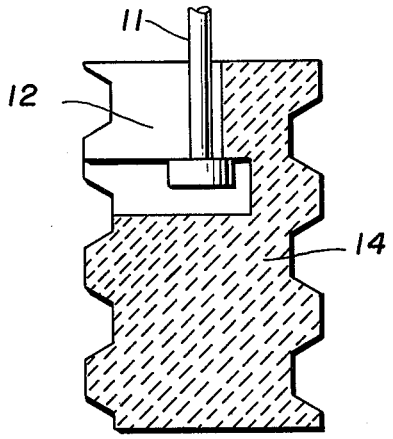
FIG. 7 is a side cross-sectional view of a sliding anchor forming one embodiment of this invention, showing in detail the hanger and a slotted ceramic block.

To accommodate the longitudinal expansion of the slotted segments a sliding anchor system is used. One embodiment thereof is shown in FIGS. 6 and 7 wherein "T" shaped hangers 11 welded to steel shell 2 are disposed within the slots 12 of a refractory anchor block 14. A suitable "T" anchor is Kaiser WN-76 manufactured by Kaiser Refractories Company.

At least one sliding anchor 11 should be provided for each slotted segment of the steel shell 2 depending upon the structural load requirements for adequate support of the refractory lining.

The remaining refractory anchors where radial deflection of the steel shell due to thermal expansion is not of concern may be conventional fixed anchors such as, for example, bent rod anchors 13 welded to steel shell 2 and imbedded angularly into refractory 3.

In a preferred embodiment, each slotted segment of the steel shell will have one or more fixed anchors for the refractory lining near the end of the slots, the slots being extended somewhat beyond the point of the fixed anchor where radial thermal expansion of the slotted segement of the steel shell is diminished to an extent that the fixed anchor will not place an unacceptable stress upon the refractory.

The foregoing description of the several embodiments of this invention is not intended as limiting of the invention. As will be apparent to those skilled in the art, the inventive concept set forth herein can find many applications in rotary kilns and many variations and modifications to the embodiments described above may be made without departure from the spirit and scope of this invention.

What is claimed is:

1. In a rotary kiln comprising a cylindrical steel shell lined with a refractory material wherein at least one end of said steel shell is exposed to a greater heat flux than the portion of said steel shell adjacent said end is exposed to, the improvement which comprises providing a plurality of generally parallel slots in said steel shell spaced substantially equi-distant around the circumference of said steel shell and extending from at least one so affected end of said steel shell to a point on said steel shell remote from said end whereat the thermal expansion of the steel shell no longer places an unacceptable stress on the refractory lining fixedly affixed thereto, said slots being of sufficient width and frequency to accommodate the circumferential expansion of the segments of said steel shell between said slots at operating temperatures, and each such slotted segment of said steel shell being affixed to the refractory lining by at least one sliding anchor means to accommodate the longitudinal expansion of each such slotted segment.

2. A rotary kiln as in claim 1 wherein said slotted end of the steel shell is fabricated of a steel having a higher thermal coeffient of expansion than the steel of said steel shell adjacent thereto.

3. A rotary kiln as in claim 2 wherein the lower thermal coefficient of expansion steel is carbon steel.

4. A rotary kiln as in claim 3 wherein the higher thermal coefficient of expansion steel is stainless steel.

5. A rotary kiln as in claim 2 wherein said slots extend through the higher thermal coefficient of expansion steel section of the steel shell into the lower thermal coefficient of expansion steel section thereof.

6. A rotary kiln as in claim 1 wherein said slotted end of the steel shell is further provided with auxiliary cooling means.

7. A rotary kiln as in claim 1 wherein the refractory material is a reinforced castable refractory.

8. In a direct-fired rotary kiln for the pyrolysis of carbonaceous material comprising a refractory lined cylindrical steel shell kiln, a feed hood proximate one end thereof, a burner hood proximate the other end thereof with burner means disposed therein, a gas discharge conduit proximate said feed hood, and means for controllably admitting an oxygen-containing gas proximate said burner hood for in situ combustion of at least a portion of the pyrolysis gases within the kiln, the improvement which comprises providing at least at the burner end of said rotary kiln a plurality of generally parallel slots in said steel shell spaced substantially equidistant around the circumference of said steel shell and extending from the end of said steel shell to a point on said steel shell remote from said end whereat the thermal expansion of the steel shell no longer places an unacceptable stress on the refractory lining fixedly affixed thereto, said slots being of sufficient width and frequency to accommodate the circumferential expansion of the segments of said steel shell between said slots at operating temperatures, and each such slotted segment of said steel shell being affixed to the refractory lining by at least one sliding anchor means to accommodate the longitudinal expansion of each such slotted segment.

9. A rotary kiln as in claim 8 wherein said slotted end of the steel shell is fabricated of a steel having a higher thermal coefficient of expansion than the steel of said steel shell adjacent thereto.

10. A rotary kiln as in claim 9 wherein the lower thermal coefficient of expansion steel is carbon steel.

11. A rotary kiln as in claim 10 wherein the higher thermal coefficient of expansion steel is stainless steel.

12. A rotary kiln as in claim 9 wherein said slots extend through the higher thermal coefficient of expansion steel section of the steel shell into the lower thermal coefficient of expansion steel section thereof.

13. A rotary kiln as in claim 8 wherein said slotted end of the steel shell is further provided with auxiliary cooling means.

14. A rotary kiln as in claim 8 wherein the refractory material is a reinforced castable refractory.

15. A rotary kiln as in claim 8 wherein the feed end of said rotary kiln is also provided with a slotted steel shell and at least one sliding anchor affixing the refractory lining to each slotted segment thereof.

* * * * *